US008240948B2

(12) United States Patent
Amaya

(10) Patent No.: US 8,240,948 B2
(45) Date of Patent: Aug. 14, 2012

(54) ROAD MARKER WITH NONPLATED LENS

(75) Inventor: Damian Amaya, Monterrey (MX)

(73) Assignee: Teknotraffic, Inc., Houston, TX (US)

( * ) Notice: Subject to any disclaimer, the term of this patent is extended or adjusted under 35 U.S.C. 154(b) by 0 days.

(21) Appl. No.: 12/903,681

(22) Filed: Oct. 13, 2010

(65) Prior Publication Data

US 2011/0085855 A1 Apr. 14, 2011

Related U.S. Application Data

(60) Provisional application No. 61/250,990, filed on Oct. 13, 2009.

(51) Int. Cl.
*E01F 9/06* (2006.01)

(52) U.S. Cl. ..... 404/16; 404/12

(58) Field of Classification Search ..... 404/9, 12–14, 404/15, 16; D10/113; 359/531, 551
See application file for complete search history.

(56) References Cited

U.S. PATENT DOCUMENTS

| | | | | |
|---|---|---|---|---|
| 2,666,373 | A * | 1/1954 | Mattson | 404/16 |
| 3,409,344 | A * | 11/1968 | Balint et al. | 359/531 |
| 4,875,798 | A * | 10/1989 | May | 404/12 |
| 5,002,424 | A * | 3/1991 | Hedgewick | 404/14 |
| 5,403,115 | A * | 4/1995 | Flader | 404/9 |
| 5,425,596 | A | 6/1995 | Steere et al. | |
| 5,502,593 | A * | 3/1996 | Hedgewick | 359/547 |
| 5,667,334 | A * | 9/1997 | Boyce | 404/9 |
| 5,667,335 | A * | 9/1997 | Khieu et al. | 404/14 |
| 5,927,897 | A * | 7/1999 | Attar | 404/12 |
| 6,126,360 | A * | 10/2000 | May et al. | 404/14 |
| 6,428,238 | B2 * | 8/2002 | Hedgewick | 404/16 |
| 6,572,305 | B2 * | 6/2003 | Forrer | 404/16 |
| 6,887,011 | B2 * | 5/2005 | Snagel | 404/14 |
| 7,001,100 | B1 * | 2/2006 | Attar | 404/16 |
| 7,025,528 | B1 * | 4/2006 | Attar | 404/16 |
| 7,153,056 | B1 * | 12/2006 | Forrer | 404/16 |

FOREIGN PATENT DOCUMENTS

KR 200376037 Y1 3/2005

OTHER PUBLICATIONS

"Part Design for Ultrasonic Welding", Technical Information PW-3, Applied Technologies Group, Emerson Industrial Automation.

* cited by examiner

*Primary Examiner* — Thomas B Will
*Assistant Examiner* — Matthew D Troutman
(74) *Attorney, Agent, or Firm* — Gifford, Krass, Sprinkle, Anderson & Citkowski, P.C.

(57) ABSTRACT

A pavement road marker is provided mounted to a road having a main shell or body having a top portion. The top portion of the body being generally planar and including a lens mounted thereon. The lens is mounted within the body so that the plane created by the lens is beneath the plane created by the planar surface of the body portion. The assembly further includes an inner cavity having a first surface and a first opening. The first opening is oppositely disposed from the top portion. The first surface of the inner cavity includes various structural elements such as protrusions, legs, or dimples. The protrusions, legs, and dimples increase surface area to improve adhesion of potting to the inner surface of the housing to fill the cavity of the housing. The legs having a lateral surface which extend on a plane normal to an outer surface of the body.

12 Claims, 3 Drawing Sheets

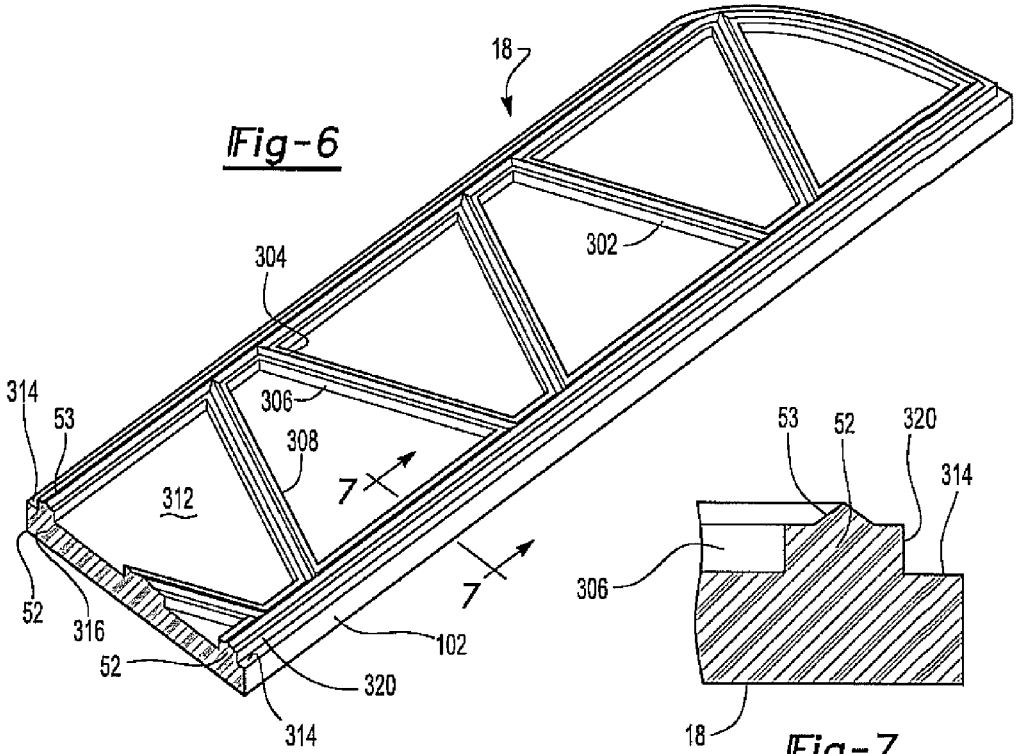
Fig-6
Fig-7
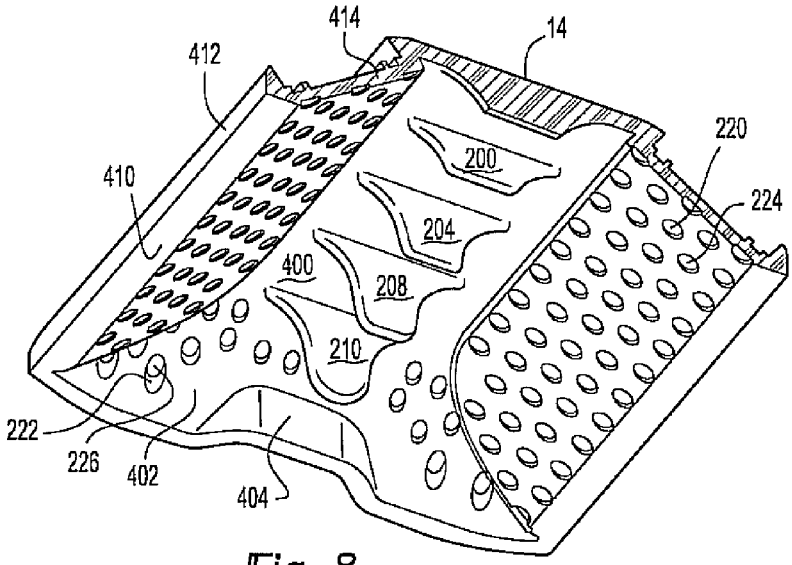
Fig-8

ROAD MARKER WITH NONPLATED LENS

CROSS-REFERENCE TO RELATED APPLICATIONS

This application claims priority of U.S. Provisional Patent Application Ser. No. 61/250,990 filed Oct. 13, 2009, which is incorporated herein by reference.

FIELD OF THE INVENTION

The invention relates generally to road markers. In particular, the invention relates to a road marker having a nonplated lens and increased structural features.

BACKGROUND OF THE INVENTION

Pavement road markers have been used for many years to delineate lanes on highways. Road markers typically have one or two retroreflective surfaces mounted in a plastic shell. The plastic shell is typically potted or filled with a resinous material to give strength and weight to the shell. Retroreflective lenses are molded of an acrylic plastic. The lens may be covered with glass to minimize scratching.

The lenses have cube corners formed on one side. The cube corners are metallized to increase the reflectivity of the lenses. The cube corners are metallized because a highly reflective surface is needed to perform a good specular reflection (like mirrors), in combination with cube corners, retroreflectivity is performed, otherwise having in contact the back of the lens and the filler having not highly reflective nature, specular reflection will be not present. Another way to have reflection is a phenomena known as Total Internal Reflection (TIR) http://en.wikipedia.org/wiki/Total_internal_reflection. TIR doesn't need a highly reflective surface, just need a combination of incidence angle and refractive index (plexiglass about 1.45/air 1.000293). TIR combined with cube corners geometry perform retroreflectivity. However, the plating process is expensive and time consuming.

The tires of vehicles pass over the road markers when the vehicles change lines. Thus, the road marker is subjected to substantial impact from vehicles, particularly heavy vehicles such as trucks. Accordingly, the road marker must be strong enough to withstand the force, and the surface of the lens must be sufficiently tough to resist scratching from stones and grit adhered to the tire tread.

SUMMARY OF THE INVENTION

A pavement road marker is provided mounted to a road having a main shell or body having a top portion. The top portion of the body being generally planar and including a lens mounted thereon. The lens is mounted within the body so that the plane created by the lens is beneath the plane created by the planar surface of the body portion. The assembly further includes an inner cavity having a first surface and a first opening. The first opening is oppositely disposed from the top portion. The first surface of the inner cavity includes various structural elements such as protrusions, legs, or dimples. The protrusions, legs, and dimples increase surface area to improve adhesion of potting to the inner surface of the housing to fill the cavity of the housing.

BRIEF DESCRIPTION OF THE DRAWINGS

FIG. 6 is a cross-sectional perspective view of the lens;

FIG. 7 is a cross-sectional view showing the beading disposed on the lens or on the housing; and FIG. 8 is a perspective underside view of the housing depicting various structural elements to improve strength and adhesion of the potting.

DETAILED DESCRIPTION OF THE INVENTION

Figure 3:
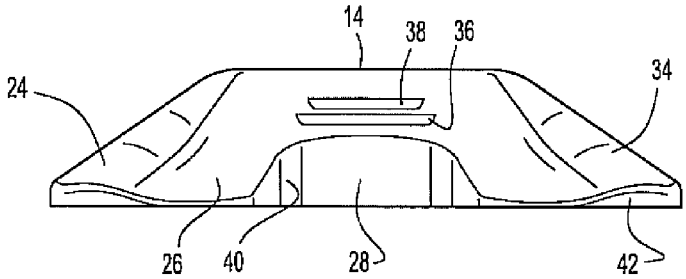
FIG. 3 is a side view showing grip enhancements on the reflector assembly.
Figure 4:
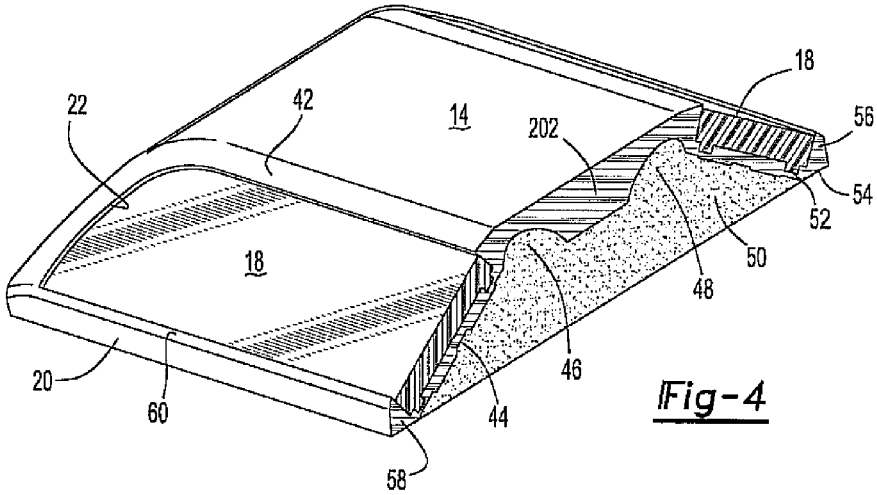
FIG. 4 is a cross-sectional perspective view of the reflector assembly including potting within the cavity of the housing.
Figure 5:
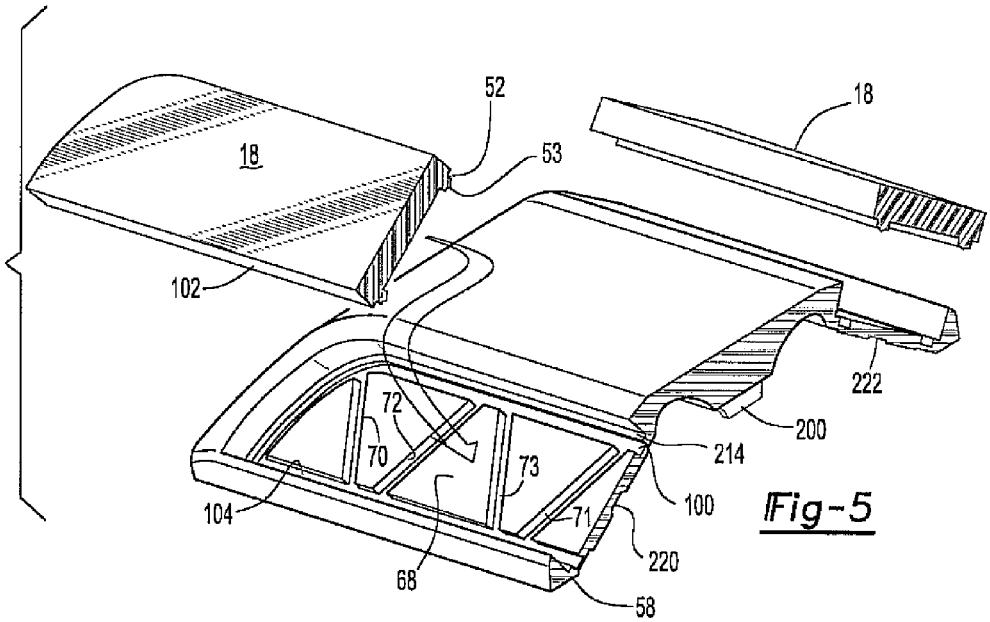
FIG. 5 is an exploded perspective cross-sectional view of the reflector assembly.

The drawings show a novel retroreflective road pavement marker 10 having a plurality of features resulting in a strong yet inexpensive pavement marker with excellent retroreflectivity. The marker includes a nonplated retroreflective lens 18 which is mounted to a plastic shell or housing 12. The housing 12 is molded out of a strong durable plastic such as ABS or PC. The housing 12 has a generally rectangular top surface 14 and a generally rectangular bottom opening 54. The housing further includes a trapezoidal cross section, as shown in FIGS. 3-5.

In the present embodiment, the housing 12 includes a plurality of surfaces all interconnected at angled edges. The housing 12 includes a side wall 26 and a side wall 24. The housing 12 further includes a top portion 14. The side wall 24, the side wall 26, and the top portion 14 are all surfaces which are angled between the top and bottom. The ends of the side wall 24, the side wall 26, and the top surface 14 all have ends gently radiused downwardly. The corners 42 between the surfaces are gently radiused to permit tires of vehicles to move smoothly and pass over the road marker or reflector assembly 10.

Figure 2:
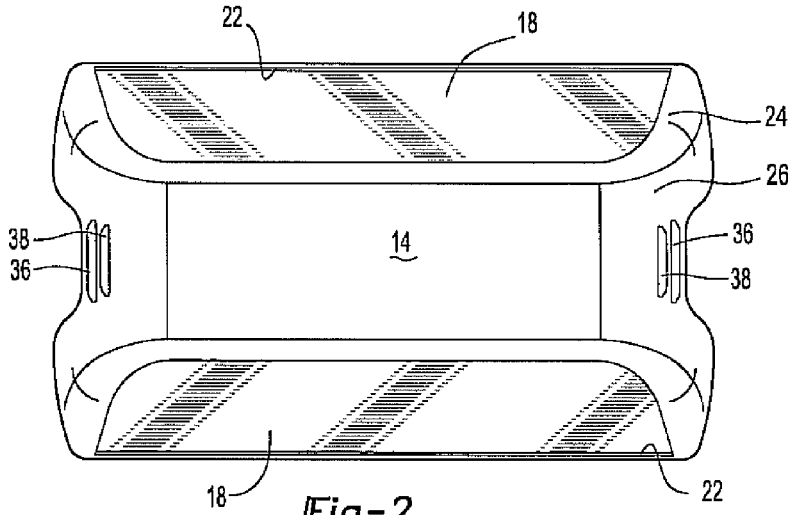
FIG. 2 is a top view of the reflector assembly having two lenses installed.

The side wall 26 includes a plurality of features to improve maneuverability, usability, and installment of the reflector assembly 10 to pavement. The side wall 26 includes a grip recession 28 to facilitate holding of the reflector assembly 10. The grip recession 28 includes a first surface 29. The first surface 29 includes a curve 40 wherein the curve of the first surface 29 curves at approximately a 90 degree angle to meet with the side wall 26. The first surface 29 may further include a second curve 30 which curves at approximately a 90 degree angle to meet with the side wall 26. The grip recession 28, when both curves 30, 40 are included, creates a generally U-shaped top view (as shown in FIG. 2).

Figure 1:
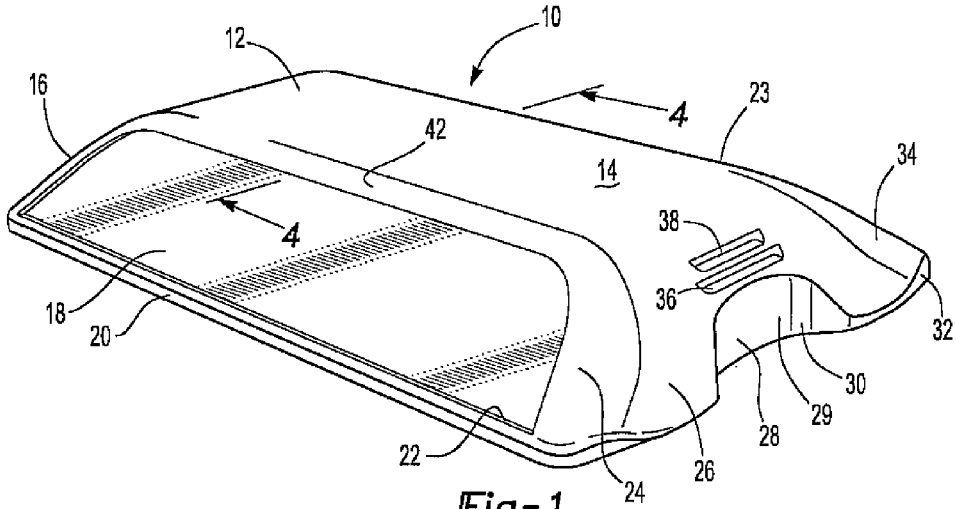
FIG. 1 is a perspective view of the reflector assembly.

Indentations 36, 38 are positioned on the sides of the housing 12 to provide finger grips for insertion or installment of the marker 10 onto the road surface. As shown in FIGS. 1-3, two generally horizontally extending indentations 36, 38 are positioned on the side wall 26 where the side wall 26 meets the top portion 14. In this embodiment, the indentations 36, 38 are positioned in the area of the side wall 26 where the side wall 26 begins to curve to meet the top portion 14. The indentations 36, 38 on the side wall 26 are provided just above the grip recession 28 to form a grip zone to facilitate holding of the marker 10.

As shown by the figures, a recess 22 on the housing 12 extends into the angled side walls (including side wall 24). In a preferred embodiment, two recesses 22, 23 are provided on either side of the housing 12. The recess 22 has a planar surface with a gridwork of grooves 70, 72 on the planar surface 68. The grooves 70, 72 are generally rectangular in cross section having a triangular edge at an end. The grooves 70, 72 form a triangular grid-like pattern on the planar surface 68.

A peripheral groove 104 extends around the surface 68. Additional grooves 71, 73 extend at an angle from the top to the bottom (or from the bottom to the top) across the surface 68 to form a triangular pattern. As shown in FIGS. 5 and 6, the triangular pattern corresponds to the pattern of tongues 52 formed on the rear side of the lens 18. The tongues 52 are generally rectangular in cross section corresponding to the dimensions of the grooves 70, 71, 72, 73 on the surface 68 in the recess 22. A bead 53 extends across the center of the tongue 52 to be used as an energy director for the ultrasonic welding of the lens 18 to the housing 12 within the recession 22. The lens 18 has cube corners formed in the area between the tongues 52. Since the lens 18 is not to be plated, it is essential to have an airtight seal between all portions of the lens 18 and the housing 12. The tongue 52 and groove 70 construction permits a strong and secure watertight seal between the lens 18 and the housing 12.

FIG. 4 shows a cross section view of the marker 10. The housing 12 is shown having a cross section 202 of one of the plurality of legs to be discussed. The legs form gaps 46, 48 wherein potting material 50 fills the gaps. Bottom corner cross sections 56, 58 at opposite ends of the housing 12 are solid material and connect to a pavement or cement surface. These areas are the cross section of the shoulder 20 of the housing 20. The shoulder 20 extends up towards the lens 18 be means of lip 60. The lip 60 is elevated above the lens 18.

When the lens 18 is installed in the recess 22 of the housing 12, the outer surface of the lens 18 is recessed inwardly up to 0.1 inch from the surface of the housing 12. The top surface of the lens 18 has a first plane. Furthermore, the planar surface of the housing 12 also includes a plane. The plane of the lens 18, when fully assembled, rests and sits below the plane of the housing 12. This difference may be up to 0.1 inch. A plurality of peripheral grooves and ledges allow the lens 18 to recess at a distance below the plane created by the housing 12. A ledge 314 extends peripherally around the lens 18 and sits on the peripheral ledge 214 within the recess 22 of the housing 12. The heights of the ledges 214, 314 are adjusted according to the preference of the manufacturer. The height and dimension of the ledges 214, 314 are adjusted, in the preferred embodiment, so that the lens 18 sits below the plane of the housing 12 0.0658 inch.

The lens 18 further includes a plurality of trapezoidal or triangular tongues designed to fit securely within the grooves 70, 72 on the surface 68 of the recession 22 of the housing 12. The tongues 306, 302 are arranged in a trapezoidal or triangular grid-like pattern on a first surface 312 of the rear of the lens 18. The tongues 302, 306 include a sealing bead 304, 308 just as the sealing bead 53 on the tongues 52. The tongues 302, 308 are generally rectangular in cross section. The recessed lens surface 68 reduces the amount of tread from the tire impacting the lens 18. This results in increasing longevity of the housing 12 however still permitting the tire to wipe the lenses when it passes over.

As shown in FIG. 8, the interior cavity 400 of the housing 12 is provided with a plurality of legs 200, 204, 208, 210 which extend outwardly and downwardly from the top of the housing 12. The legs 200, 204, 208, 210 have a generally planar surface with a thin cross section. The legs 200, 204, 208, 210 are aligned on axes which extend between the lenses 18. The legs 200, 204, 208, 210 extend towards the bottom of the housing 12, however stop short of the bottom.

The legs 200, 204, 208, 210 are progressively truncated from the sides of the inner surface 402 of the housing 12 towards the center of the inner cavity 400 of the housing 12. The length of the legs 200, 204, 208, 210 begins at approximately 0.500 inch and decreases to approximately 0.160 inch. This permits a certain amount of resiliency to the housing 12, particularly at the center portion. However, the planar surfaces provide good bonding surfaces for potting material 50 when the interior or cavity 400 of the housing 12 is filled. The potting material 50 is typically a polymer resin. The legs 200, 204, 208, 210 extending from the inner cavity 200 and inner surface 40 toward the opening each have a lateral surface which extends on a plane normal to the outer surface of the housing 12.

The resin surrounds the legs 200, 204, 208, 210 and is locked to the shell once the resin is cured. Perforations or dimples 220, 224 are also formed on the first surface 402 of the inner cavity 400 of the housing 12. The dimples 220, 224 include a side wall 222 and a bottom wall 226. The cross section 414 of the housing 12 is also provided.

The dimples 220, 224 are generally circular. The dimples provide for increased surface area of the first surface 402 for potting material 50 to adhere to. FIG. 4 further shows inner surface 404 of the grip 28. Potting material 50 adheres to the inner surface 404. Shoulder 410 and lip 412 are also disposed in the inner cavity 404. In this embodiment, the shoulder 410 abuts a cement or pavement surface and the lip 412 extends up and away from the cement or pavement.

The invention is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the appended claims.

The invention claimed is:

1. A reflector assembly mounted to a road, the reflector assembly comprising:

a lens;

a housing having a front wall and a back wall, the lens received by either the front wall or the back wall, a longitudinal axis extending between and parallel to the front wall and the back wall, a center portion and an inner surface, the inner surface defining a cavity having a first opening, the inner surface having a plurality of legs extending from the inner surface toward the opening;

each of the plurality of legs having a predetermined length, the plurality of legs disposed along the longitudinal axis between the front wall and the back wall, each of the plurality of legs having a lateral surface with extends on a plane generally perpendicular to the longitudinal axis, the plurality of legs having at least one outermost leg and at least one center leg, the plurality of legs being progressively shorter in length from the outermost leg to the center leg; and a potting material within the cavity of the housing;

whereby each of the plurality of legs strengthens the housing while permitting resiliency in the center portion.

2. The reflector assembly of claim 1, wherein the lens includes a first surface.

3. The reflector assembly of claim 2, wherein an outer surface of the housing includes a recess adapted to accept the lens.

4. The reflector assembly of claim 3, wherein the lens sits within the recess.

5. The reflector assembly of claim 4, wherein the first surface of the lens sits below a plane of the outer surface.

6. The reflector assembly of claim 1, wherein the inner surface contained within the cavity includes at least one recess.

7. The reflector assembly of claim 1, wherein the predetermined length of each of the plurality of legs ranges between 0.1 inch and 2 inches.

8. The reflector assembly of claim 1, wherein the potting material adheres to the inner surface of the cavity of the housing.

9. The reflector assembly of claim 8, wherein the potting material is polyurethane resin.

10. The reflector assembly of claim 1, wherein either the front wall or the back wall of the housing includes a recess operable to accept the lens.

11. The reflector assembly of claim 1, wherein the housing is made of a moldable polymer.

12. The reflector assembly of claim 1, wherein the housing is made of a resilient polymer.

* * * * *